US008534213B2

(12) United States Patent
Chitwood et al.

(10) Patent No.: US 8,534,213 B2
(45) Date of Patent: Sep. 17, 2013

(54) SKID SHOE ASSEMBLY FOR LOADING AND TRANSPORTING LARGE STRUCTURES

(75) Inventors: James Scott Chitwood, Cypress, TX (US); David Alex Knoll, Houston, TX (US); Edward Stephen Piter, Spring, TX (US); William Michael Pritchett, Houston, TX (US); Roy Keith Smith, Katy, TX (US); Wilbert Ray Ulbricht, Katy, TX (US)

(73) Assignee: Shell Oil Company, Houston, TX (US)

( * ) Notice: Subject to any disclaimer, the term of this patent is extended or adjusted under 35 U.S.C. 154(b) by 44 days.

(21) Appl. No.: 13/201,876

(22) PCT Filed: Feb. 16, 2010

(86) PCT No.: PCT/US2010/024273

§ 371 (c)(1),
(2), (4) Date: Sep. 27, 2011

(87) PCT Pub. No.: WO2010/096373

PCT Pub. Date: Aug. 26, 2010

(65) Prior Publication Data

US 2012/0247380 A1 Oct. 4, 2012

Related U.S. Application Data

(60) Provisional application No. 61/153,332, filed on Feb. 18, 2009.

(51) Int. Cl.
*B63B 35/44* (2006.01)

(52) U.S. Cl.
USPC ..... 114/258

(58) Field of Classification Search
USPC ..... 114/258, 259, 260
See application file for complete search history.

(56) References Cited

U.S. PATENT DOCUMENTS

| | | | | |
|---|---|---|---|---|
| 4,086,777 | A * | 5/1978 | Lai | 405/195.1 |
| 4,345,536 | A * | 8/1982 | Gregg | 114/124 |
| 4,683,832 | A * | 8/1987 | Dysarz | 114/258 |
| 4,864,957 | A * | 9/1989 | Edgar et al. | 114/258 |
| 5,097,786 | A * | 3/1992 | Sheffield | 114/258 |
| 5,290,128 | A | 3/1994 | Yeagain et al. | 405/209 |
| 5,388,930 | A | 2/1995 | McNease | 405/209 |
| 6,276,875 | B1 * | 8/2001 | Gunnar et al. | 405/203 |
| 6,354,765 | B2 | 3/2002 | Jones | 405/203 |
| 6,676,334 | B2 * | 1/2004 | Horton, III | 405/205 |
| 6,923,598 | B2 * | 8/2005 | Vatsvag | 405/203 |
| 7,350,475 | B2 | 4/2008 | Borgwarth et al. | 114/260 |
| 8,251,004 | B2 * | 8/2012 | Olsen et al. | 114/258 |
| 2011/0290499 | A1 * | 12/2011 | Petegem et al. | 166/350 |

FOREIGN PATENT DOCUMENTS

| | | |
|---|---|---|
| JP | 59092284 | 5/1984 |
| KR | 100424201 | 11/2002 |
| KR | 1020020094968 | 12/2002 |
| WO | WO2006038749 | 4/2006 |

* cited by examiner

*Primary Examiner* — Lars A Olson
*Assistant Examiner* — Jovon Hayes

(57) ABSTRACT

A system comprising a floating vessel comprising a deck having a longitudinal axis and a lateral axis; a plurality of support structures in an array spaced along the longitudinal axis and the lateral axis; a plurality of lateral support members spanning a lateral distance between adjacent support structures; a plurality of longitudinal support members spanning a longitudinal distance between adjacent support structures; a skid beam resting on the plurality of lateral support members and the plurality of longitudinal support members; and a skid shoe resting on the skid beam.

14 Claims, 2 Drawing Sheets

SKID SHOE ASSEMBLY FOR LOADING AND TRANSPORTING LARGE STRUCTURES

PRIORITY CLAIM

The present application claims priority from PCT/US2010/024273, filed 16 Feb. 2010, which claims priority from U.S. Provisional Application No. 61/153,332, filed 18 Feb. 2009.

FIELD OF THE INVENTION

The invention is directed to systems and methods for loading and transporting large structures over bodies of water.

BACKGROUND OF INVENTION

International Patent Publication number WO 2006/038749 discloses a method and the equipment for transversely launching a ship built on the ground. The method comprises a ship building step for building a ship on the ground; a preliminary Jacking-Up step for lifting up the built ship by means of a plurality of skid shoes and hydraulic jacks; a ship moving step for skidding the skid shoes and hydraulic jacks which support the ship on skid beams using traction devices, thereby transversely moving the ship toward a barge; a ship loading step for loading the moved ship onto the barge; and a ship launching step for floating the ship by submerging the barge on which the ship is loaded. WO 2006/038749 is herein incorporated by reference in its entirety.

U.S. Pat. No. 6,354,765 discloses a method for disposing of an offshore platform jacket by suspending the jacket in one piece under a tow vessel, towing it to the disposal site and safely and quickly releasing the jacket at the disposal site. Once the jacket foundation piles have been severed, the first end of the jacket is lifted using a derrick barge crane or winch connected to a first lift rigging means until the first lift rigging means engages with a first release means. The second end is lifted in a similar manner with a second lift rigging means and a second release means until the jacket is suspended substantially beneath the tow vessel. The lift rigging means include a spreader bar having at least one skid shoe attached thereto, at least two padeyes attached at opposite ends of the spreader bar, a lift sling attached to the padeyes and at least two jacket support slings. Each release means is attached to the tow vessel and includes at least one rocker beam having a connector. The rocker beam is adapted to pivot about a pivot point upon disengaging the connector. Once the jacket has been towed under the tow vessel to the disposal site, the connectors can be disengaged thus allowing each rocker beam to pivot and the jacket to be released. U.S. Pat. No. 6,354,765 is herein incorporated by reference in its entirety.

U.S. Pat. No. 4,864,957 discloses an apparatus for recovery and launch of secondary watercraft such as SALM bases, barges and the like onto and from the deck of a host ship, comprising a pair of elongated inclined skid beam assemblies extending transversely across the host ship defining a pair of parallel skid paths spaced apart longitudinally of the ship, each skid beam assembly comprising a stationary skid beam section and a hinged skid beam section. The stationary skid beam section has a substantially rectilinear skid surface spanning a major portion of the width of the ship's deck and extending in an inclined plane relative to the deck defining a wedge-like skid formation converging toward a side of the vessel for slidably supporting the secondary watercraft during launch and recovery thereof. A hinge block supports the hinged beam at an end of its associated stationary skid beam section adjacent a lateral margin of the deck for swivel movement about a pivot axis lying in a vertical transverse plane and extending perpendicular to the inclined plane of the skid surfaces of the stationary and hinged beam sections. U.S. Pat. No. 4,864,957 is herein incorporated by reference in its entirety.

U.S. Pat. No. 5,290,128 discloses a skidbase and a drilling structure are adapted for transfer between a jack-up platform and a fixed platform. The jack-up platform is moved into position adjacent the fixed platform and raised to a height aligned with the fixed platform. The skidbase is then transferred onto the fixed platform to provide a base on which the drilling structure is next placed. The jack-up platform is raised to a vertical height aligned with the skidbase. To ensure proper location of the top surface of the jack-up platform relative to the skidbase, a connection means automatically engages and aligns the jack-up platform with the skidbase so that skid rails located on the deck of the jack-up platform and on a top surface of the skidbase are positioned a precise distance apart and at the same vertical height. The drilling structure is then skidded onto the skidbase so that drilling operations may be performed from the fixed platform. The connection means takes the form of a multi-dimension blade member affixed to the skidbase. The blade member progressively engages a series of guide members on the jack-up platform and, thereby, progressively and stagewise aligns the skidbase as the jack-up platform is moved to its desired vertical height. U.S. Pat. No. 5,290,128 is herein incorporated by reference in its entirety.

U.S. Pat. No. 5,388,930 discloses a method and apparatus for transporting and using a drilling apparatus or a construction crane apparatus from a single moveable vessel. Either a drilling apparatus or a construction crane apparatus is skidded onto the deck of a jack-up rig which is then floated to a remote location for use of the apparatus. The skidding of the construction crane apparatus is facilitated by a new and unique pony structure to raise the base of the construction crane apparatus above a skid on the jack-up rig. U.S. Pat. No. 5,388,930 is herein incorporated by reference in its entirety.

U.S. Pat. No. 7,350,475 discloses a method and apparatus for launching and recovering an object by a host vessel while the host vessel is in motion. The recovery system utilizes a tethered capture system for connecting with the object and then directing the object to the host vessel where it is secured. The tethered capture system includes one or more side planers that direct a capture cable away from the host vessel. The capture cable is preferably disposed below the waterline through the use of a diving rig or extended cable struts so that the cable does not foul the propeller of the object to be recovered. The side planer itself may include a ramped surface for loading the object prior to securing to the host vessel. After the capture, the object may be secured by way of a boom attached to the host vessel or by a lifting cradle that selectively extends aft of the host vessel. U.S. Pat. No. 7,350,475 is herein incorporated by reference in its entirety.

SUMMARY OF INVENTION

One aspect of the invention provides a system comprising a floating vessel comprising a deck having a longitudinal axis and a lateral axis; a plurality of support structures in an array spaced along the longitudinal axis and the lateral axis; a plurality of lateral support members spanning a lateral distance between adjacent support structures; a plurality of longitudinal support members spanning a longitudinal distance between adjacent support structures; a skid beam resting on the plurality of lateral support members and the plurality of longitudinal support members; and a skid shoe resting on the skid beam.

DETAILED DESCRIPTION OF THE DRAWINGS

Figure 1:
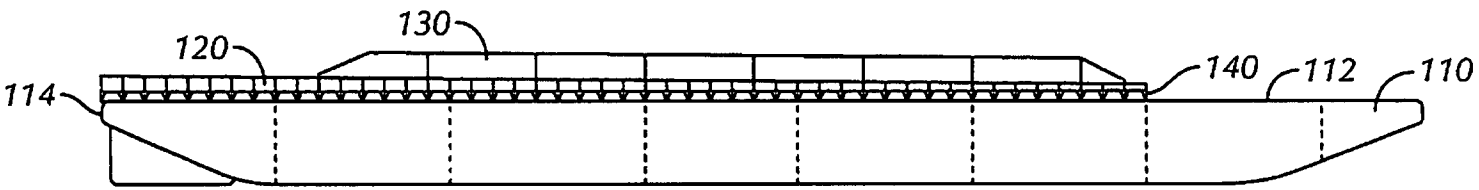
FIG. 1 shows a perspective view of a transport vessel with a skid beam assembly in accordance with embodiments of the present disclosure.

In one aspect, embodiments disclosed herein relate generally to apparatuses and methods for loading and transporting large structures over bodies of water. Specifically, embodiments disclosed herein relate to a structure that may be disposed on a transport vessel, such as a barge, that enables larger structures to be transported on the transport vessel.

A large structure, such as an oil platform or an oil rig, may be used to house machinery and/or workers used within the oil and gas industry to drill and/or extract oil and gas (i.e., hydrocarbons) through wells formed in the ocean bed. This platform or oil rig, depending on the environment and circumstances at the location of the hydrocarbons, may be attached to the ocean floor, may be formed as an artificial island, or may be floating at a desired location.

Offshore structures may be located on the continental shelf, though improvements in technology have enabled drilling and production of hydrocarbons in deeper waters and environments to be both feasible and profitable. A typical offshore structure may then include around thirty wellheads located about the platform, in which directional drilling enables reservoirs to be accessed at both different depths and positions up to 10 kilometers away from the structure. Offshore structures may be of various types, including fixed platforms, semi-submersibles, jack-ups, floating production systems ("FPSO's"), tension leg platforms, SPAR platforms, and others known to those skilled in the art.

In an offshore oil platform, the "topsides" of the platform may generally refer to the surface hardware installed above the water. This may include an oil production plant, workers' housing quarters, a drilling rig and other drilling equipment, and any other equipment known to those skilled in the art. Topsides may be modular in design, in which the topsides may be rearranged to enable expensive platforms to be readily updated with newer or different technology. Typical topsides may range in size, such as from about 6,000 short tons to about 10,000 short tons (5440 metric tons to 9070 metric tons), depending on the size and needs of the project. As such, large transport vessels, typically barges, may be used to transport the topsides from a construction yard on land to the desired offshore site. These topsides may then be transported in a single unit, or the topsides may be divided into portions for transport.

As oil exploration and production moves to deeper waters, though, larger structures such as oil platforms and topsides may be required. Typically, a larger barge that provides more buoyancy for loadout and additional stability during transportation is used to transport the larger topsides. In turn, this may limit the barges that may be used for transport, as there may only be a select few barges that are large enough to handle the larger topsides. Other alternatives to accommodate larger loads have included sponsons or other buoyancy devices attached to the transport vessel. Accordingly, there exists a need to outfit a normal sized barge to handle larger topsides and/or other equipment for transport to offshore sites.

FIG. 1

Referring to FIG. 1, a transport vessel, or barge, 110 having a skid beam assembly 120 disposed thereon in accordance with embodiments of the present disclosure is shown. A tapered skid beam 120 is placed on the deck of the barge 110. As shown, in one embodiment, rather than having the skid beam assembly 120 placed directly on the deck 112 of the transport vessel 110, one or more support structures 140 may be placed on the deck 112 of the transport vessel 110. The skid beam assembly 120 may then be placed on top of the support structures 140. The taper of the skid beam 120 may increase towards the stern 114 of the barge 110, such that the stern 114 of the barge 110 is lowered deeper into the water. In effect, this lowers the vertical center of gravity "COG" of the barge 110, as well as increases the barges' 110 buoyancy. The skid beam 120 is discussed in greater detail in co-pending application 61/153,331, which is incorporated herein in its entirety.

Still referring to FIG. 1, a dual integrated skid shoe 130 is positioned on top of the skid beam 120. As shown, the dual integrated skid shoe 130 is configured to lay directly on top of the skid beam 120. Means of attaching and securing the skid shoe 130 to the skid beam 120 will be known to those skilled in the art, for example, mechanical fasteners (e.g., bolts, screws), or welding.

Figure 2D:
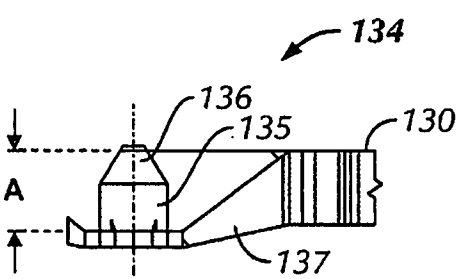
FIG. 2D shows an elevation view of a lift guide in accordance with embodiments of the present disclosure.
Figure 2C:
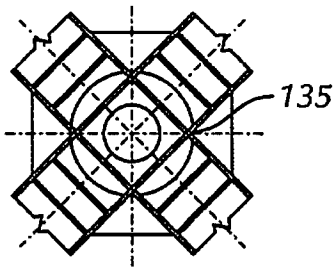
FIG. 2C shows a detailed layout view of a lift guide in accordance with embodiments of the present disclosure.
Figure 2A:
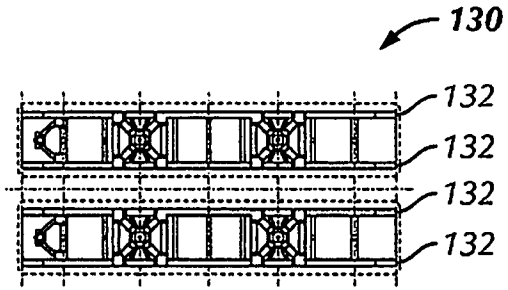
FIG. 2A shows a layout view of a dual integrated skid beam in accordance with embodiments of the present disclosure.
Figure 2B:
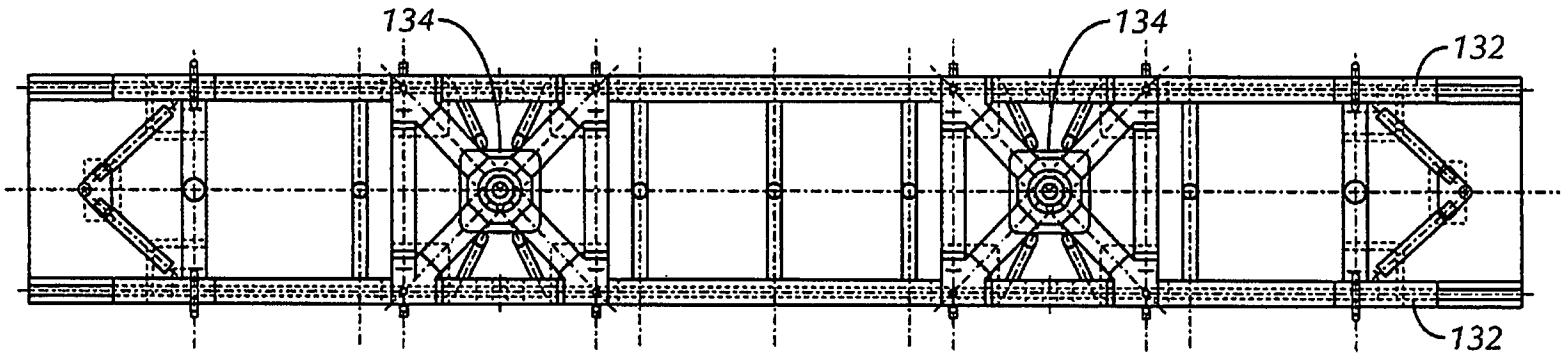
FIG. 2B shows a detailed layout view of one half of the dual integrated skid beam in accordance with embodiments of the present disclosure.

FIGS. 2A-2D:

Now referring to FIG. 2A, a layout view of the skid shoe 130 is shown in accordance with embodiments of the present disclosure. The skid shoe 130 includes four long beams 132 that run longitudinally (from bow to stern) when placed on the skid beam 120 (FIG. 1) on the barge 110 (FIG. 1). One of ordinary skill in the art will appreciate that the skid shoe 130 may include four or more beams 132. The beams 132 may be I-beams, square beams, or other cross-sections known to those skilled in the art. FIG. 2B shows a more detailed layout view of one half of the skid shoe 130. Each half of the skid shoe 130 includes two lift guides 134 on which deck legs of the topside (not shown) may rest when the topside is loaded onto the barge 110 (FIG. 1).

A "footprint" of the lift guides 134 on the skid shoe 130 may be custom fit to accommodate the footprint of the topside to be transported offshore. One of ordinary skill in the art will appreciate that the footprint of the lift guides will match according to the footprint of the topside deck legs, in both the number of lift guides needed and the pattern in which they are arranged. The lift guides 134 are disposed below the top surface of the skid shoe so as to provide a lowered vertical center of gravity as discussed in detail later. Additional structure may include necessary cross-bracing as will be known to those skilled in the art. The skid shoe 130 may be constructed of mainly steel. The skid shoe may be coated with a corrosion resistant coating to withstand the offshore environment, and also to protect the integrity of the welds.

Referring now to FIG. 2D, an elevation view of a lift guide 134 is shown in accordance with embodiments of the present disclosure. As shown, lift guide 134 includes a tapered portion 136 with which the deck legs of the topside (not shown) may initially engage. The tapered portion 136 may also help with initial alignment of the deck legs onto the lift guides 134 during loadout. The lift guide 134 also includes a cylindrical portion 135 on which the deck legs of the topside may rest when loaded. One of ordinary skill in the art will appreciate that the geometry of the deck legs determines the geometry of the lift guides. For example, if the deck legs have a square or polygonal cross-section, the lift guides 134 are configured with a corresponding square of polygonal cross-section. The lift guides 134 are positioned at a height below the top of the skid shoe 130 due to a downwardly directed extension member 137 of the skid shoe 130. The extension member 137 is shown as a single piece, however, in alternate embodiments, the extension member 137 may include several pieces welded or fastened together.

As shown, lift guides 134 are disposed at a distance "A" below the top of the skid shoe 130. This distance may range between about 6 inches and about 1 foot, depending on the size of the topside. The size of the topside may vary depending on the capabilities of the yard in which the topside will be loaded. Those skilled in the art will understand limitations imposed by the yard and the barge onto which the topside will be loaded. For example, certain yards may only be capable of loading up to certain sized topsides; therefore, the skid beam that will be used to transport said topsides may be manufactured accordingly.

Positioning the lift guides 134 below the top of the skid shoe 130 provides that the overall vertical COG of the barge and topside is lowered when the topside is loaded onto the transport vessel. By lowering the vertical COG, the stability of the topside and transport vessel during transportation offshore may be greatly improved. This may make the barge and topside much less susceptible to rough seas, high winds, or other factors which may cause the transport vessel to capsize.

Computer analysis programs, such as ANSYS, may be used to test the loadout and transportation suitability of the skid shoe 130. Testing may include simulating the loaded barge in the water under different loads to determine an optimum height at which the barge should sit in the water for certain topsides.

Advantageously, embodiments of the present disclosure may provide a barge that is capable of transporting topsides that may typically have been too large. Due to the lowered vertical center of gravity and the increased buoyancy, the barge is able to carry more weight while maintaining stability. The operator may not have to wait for a larger vessel, which may take unnecessary extra time and require certain fees. Therefore, the transportation of the barge will not be delayed and the costs of transportation may be reduced.

Illustrative Embodiments

In one embodiment, there is disclosed a system comprising a floating vessel comprising a deck having a longitudinal axis and a lateral axis; a plurality of support structures in an array spaced along the longitudinal axis and the lateral axis; a plurality of lateral support members spanning a lateral distance between adjacent support structures; a plurality of longitudinal support members spanning a longitudinal distance between adjacent support structures; a skid beam resting on the plurality of lateral support members and the plurality of longitudinal support members; and a skid shoe resting on the skid beam. In some embodiments, the skid beam is inclined at an angle from 0.1 to 3 degrees relative to the floating vessel deck along the longitudinal axis. In some embodiments, the skid beam is inclined at an angle from 0.5 to 1.5 degrees relative to the floating vessel deck along the longitudinal axis. In some embodiments, the skid beam further comprises a raised edge along at least one of its sides. In some embodiments, the system also includes a connection between a lateral support member and a longitudinal support member, the connection selected from the group consisting of bolts and welds. In some embodiments, the support structures comprise from 2 to 3 base members. In some embodiments, the skid shoe comprises a plurality of beams along the longitudinal axis. In some embodiments, the skid shoe further comprises a plurality of lift guides. In some embodiments, the skid shoe further comprises at least one lift guide recessed a distance below a top of the skid shoe. In some embodiments, the distance is from about 3" to about 24", for example from about 6" to about 12". In some embodiments, the lift guide comprises a male connector, optionally comprising a tapered portion. In some embodiments, the system also includes an offshore structure resting on the skid shoe, the offshore structure comprising female receptacle adapted to connect to the male connector. In some embodiments, each of the lift guides are located between two of the beams along the longitudinal axis. In some embodiments, the system also includes an offshore structure resting on the skid shoe, the offshore structure comprising a topsides structure. In some embodiments, the skid beam comprises a plurality of sections connected to each other at a lateral beam.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A system comprising:

a floating vessel comprising a deck having a longitudinal axis and a lateral axis;

a plurality of support structures in an array spaced along the longitudinal axis and the lateral axis;

a plurality of lateral support members spanning a lateral distance between adjacent support structures;

a plurality of longitudinal support members spanning a longitudinal distance between adjacent support structures;

a skid beam resting on the plurality of lateral support members and the plurality of longitudinal support members; and a skid shoe resting on the skid beam, wherein the skid shoe comprises at least one lift guide recessed a distance below a top of the skid shoe.

2. The system of claim 1, wherein the skid beam is inclined at an angle from 0.1 to 3 degrees relative to the floating vessel deck along the longitudinal axis.

3. The system of claim 1, wherein the skid beam is inclined at an angle from 0.5 to 1.5 degrees relative to the floating vessel deck along the longitudinal axis.

4. The system of claim 1, wherein the skid beam further comprises a raised edge along at least one of its sides.

5. The system of claim 1, further comprising a connection between a lateral support member and a longitudinal support member, the connection selected from the group consisting of bolts and welds.

6. The system claim 1, wherein the support structures comprise from 2 to 3 base members.

7. The system of claim 1, wherein the skid shoe comprises a plurality of beams along the longitudinal axis.

8. The system of claim 1, wherein the skid shoe further comprises a plurality of lift guides.

9. The system of claim 1, wherein the distance is from about 3" to about 24".

10. The system of claim 1, wherein the lift guide comprises a male connector.

11. The system of claim 10, further comprising an offshore structure resting on the skid shoe, the offshore structure comprising female receptacle adapted to connect to the male connector.

12. The system of claim 8, wherein each of the lift guides are located between two of the beams along the longitudinal axis.

13. The system of claim 1, further comprising an offshore structure resting on the skid shoe, the offshore structure comprising a topsides structure.

14. The system of claim 1, wherein the skid beam comprises a plurality of sections connected to each other at a lateral beam.

* * * * *